United States Patent [19]

Schulte et al.

[11] Patent Number: 5,005,981

[45] Date of Patent: Apr. 9, 1991

[54] APPARATUS FOR METHOD FOR CAUSING VORTICES IN A TEST TUBE

[75] Inventors: Harvey Schulte, Los Altos; Sal Noto, Sunnyvale, both of Calif.

[73] Assignee: Becton, Dickinson and Company, Franklin Lakes, N.J.

[21] Appl. No.: 405,803

[22] Filed: Sep. 8, 1989

[51] Int. Cl.[5] ..... B01F 13/08

[52] U.S. Cl. ..... 366/219; 494/16; 494/17; 494/18; 435/315; 435/313; 435/287; 435/2

[58] Field of Search ..... 366/219, 208, 209, 210, 366/211, 213, 214, 216, 217, 219, 232, 110, 111; 494/16, 17, 18, 19; 422/99, 100; 435/2, 206, 315, 316, 312, 287

[56] References Cited

U.S. PATENT DOCUMENTS

| | | | |
|---|---|---|---|
| 3,159,384 | 12/1964 | Davis | 366/110 |
| 4,555,183 | 11/1985 | Thomas | 366/208 |
| 4,845,025 | 7/1989 | Lary et al. . | |
| 4,848,917 | 7/1989 | Benin et al. | 366/110 |

*Primary Examiner*—Harvey C. Hornsby
*Assistant Examiner*—Gary K. Graham
*Attorney, Agent, or Firm*—Aaron Passman

[57] ABSTRACT

A test tube handling assembly has an elongate member with an end for engaging a test tube and an end opposite thereto driven about an axis of the member for orbital movement with its axis. The member is a slender rod with a spherical bearing about a center part thereon between the ends thereof and along its axis. An arm extends from a support to carry the spherical bearing and permit limited motion of the rod relative to the support. A gripping means on the end for engaging the test tube holds the test tube and its contents during movement of the rod relative to the axis. A drive located on the support near the end opposite causes the test tube to swing about the center part. Contacting means with a seal for closing the open end of the test tube is part of an inflatable bladder which holds the open end of the test tube by fitting in the open end of the test tube. The drive has a motor for providing orbital motion. The motor axis and the member axis are in spaced parallel relation relative to each other with a linkage means therebetween to cause the axis of the member to move about the axis of the motor imparting an orbital motion to the end opposite of the member thereby orbiting the end for engaging the test tube. A three axis positioning means carries the support by connection with a releasable latching means. A method has steps of holding a test tube by the gripping means, moving the test tube repetitively with the drive and generating orbital movement of the test tube and sample therein for producing a vortex in the test tube sample.

10 Claims, 4 Drawing Sheets

APPARATUS FOR METHOD FOR CAUSING VORTICES IN A TEST TUBE

BACKGROUND OF THE INVENTION

1. Field of the Invention

This invention relates to an apparatus and method for causing vortices in test tube samples, and more specifically, to an apparatus and method for selectively and automatically causing vortices in a test tube and adding and removing samples therefrom.

2. Background Description

Frequently laboratory samples have to be mixed as part of a test procedure so that the portion of the sample tested or analyzed is representative of the entire specimen. A variety of test equipment available to mix or shake test samples directly stirs the test sample in its container or shakes the container and sample. Stirring devices usually include a member which is placed into the sample within the container to spin the sample about the axis of the member. Typically the member has to be cleaned after use and the container is subject to the stresses imposed by contact with the member during stirring.

The most commonly used laboratory sample mixing equipment is designed to shake the container and its contents to eliminate the need to clean a mixing or stirring member. Shaking the container and the contents works well for messy materials including paints and lubricants. Similarly, dangerous substances such as acids and other active chemicals are mixed within the container thus eliminating concern about destruction of, or contact with the stirring member.

Biohazardous substances are frequently tested for deadly cancers, virus, infection or the like and thus typically require particular care during handling. Consequently, laboratory mixing and stirring equipment which does not include a member that contacts the hazardous specimens is safer to use than stirring members which have to be handled. Another form of mixer includes a flat shaker table upon which the sample container is placed. Often the laboratory vessel has a flat bottom which can be placed upon the vibrating table that moves in a plane in two directions imparting orbital motion to the container and sample. The orbital motion agitates the sample. Problems with handling and cleaning flat bottomed vessels remain a concern even though vibrating tables are inexpensive to make and use. Vibrating tables are not suited for use with test tubes. Samples are usually in a test tubes with spherically shaped bottoms that are inexpensive and disposable or are easy to clean and reuse.

Shakers can be used for mixing the contents of one container with several test tubes. The individual handling of test tubes is slow and automated handling presents the difficulty of being unable to have equal incubation times for all the samples. Specifically, as the samples are prepared one at a time in each test tube prior to mixing as a group, delays occure resulting in some of the samples incubating longer than others.

Various test tube shaking, rotating and revolving devices have been developed and used for mixing the contents of a plurality of test tubes. One device holds a number of test tubes in a rack designed to individually support each test tube near the longitudinal middle of each tube so that the rack and tubes can be swung about the midpoint of the axes of the tubes to mix the samples sealed within the tubes. The problem with swinging racks of sealed test tubes is handling since each tube has to be sealed and placed in the rack. A variation of such swinging rack mixers merely swings the tube through a small arc to agitate the contents without spillage even though the tubes are unsealed.

Vortex causing mixers are frequently used to mix the contents of individual test tubes by placing the rounded bottom end of a single tube into a rubber pocket which has a switch activated by pressing the test tube into the pocket. Closing the switch makes the vortex causing mixer orbit the rounded test tube bottom about the longitudinal axis of the test tube. The top of the test tube is hand held in substantially one place such that the lower end of the test tube orbits establishing a vortex in the sample. Motion of the test tube is designed to cause a vortex in the sample due to the eccentrically orbiting resilient pocket into which the bottom of the test tube is manually placed while the top of the test tube is held stationary by a laboratory technician. The technician must control the mixing by varying the angle of contact and pressure on the drive cup during mixing. One such manually operated mixer is the VWR Vortex Mixer manufactured by Scientific Industries, Inc. of Bohemia, N.Y., as disclosed in U.S. Pat. No. 3,061,780. Each test tube and sample must be individually placed in the pocket so samples can be individually caused to vortex.

Certain analytical equipment is designed to handle a plurality of samples carried in special racks from which the samples can be accessed automatically. Such analytical equipment requires that the samples be mixed in order to provide a homogenous or representative portion of the specimen to be tested. Automatic accessing of the samples from each test tube means that each tube with a well mixed sample has to be held in a rack which positions each tube for access such a rack does not provide for automatic mixing. Presently available test tube racks or mixing equipment are not designed to minimize handling by the technician during mixing or to cooperate with analytical equipment.

SUMMARY OF THE INVENTION

The preferred embodiment includes an apparatus which is a test tube handling assembly for causing a vortex in a test tube sample. The assembly most preferably may comprise an elongate member with an end for engaging a test tube and an end opposite thereto driven about an axis of the member for movement relative to the axis thereof. The member has a center part thereon between the ends thereof and along the axis. A support for the member may have an arm extending from the support to carry a spherical bearing for the center part of the member and permit limited motion of the member relative to the support. A test tube gripping means on the end for engaging the test tube may hold the test tube and the contents thereof during movement of the member relative to the axis. A drive located on the support near the end opposite is in contact with the gripping means. The preferred drive has a motor for providing rotary motion about a motor axis. The motor axis and the member axis are in spaced parallel relation relative to each other with a linkage means therebetween to cause the axis of the member to orbit by imparting an orbital motion to the end opposite of the member thereby orbiting the end for engaging the test tube.

In the preferred handling assembly the test tube gripping means may have test tube contacting means for holding an open end of the test tube during movement of the member. The test tube contacting means includes a seal for substantially closing the open end of the test tube and in the preferred form is an inflatable bladder which upon inflation holds the open end of the test tube. The inflatable bladder fits within the open end of the test tube.

The arm preferably extends from the support to carry the member center part in spaced apart relation with respect to the support so that movement of the member about the center part and relative to the axis is permitted without contact between the support and the test tube or the member. The member most preferably includes a slender rod so the spherical bearing permits orbital motion of the axis of the rod and swinging movement about the center part. The center part of the rod has a point on the axis of the rod which is free from movement as the rod orbits about its axis and swings relative to the point about the elongate length of the rod. The end for engaging may carry a passage so samples can be added or removed from the test tube.

The support may include a three axis positioning means for the elongate member and wherein one of the axes of movement of the three axis positioning means is substantially parallel with the axis of the member and the other two axes of movement of the three axis positioning means are normal to the axis of the member. The member may be releasably latched to the three axis positioning means to be moved thereby.

Another form of the preferred invention is a method for causing a vortex in a test tube sample by the preferred test tube handling assembly with the steps of holding a test tube by the gripping means during movement of the member relative to the axis, moving the test tube repetitively with the drive to cause the test tube to orbit relative to the axis and to swing about the center part of the member and generating orbital movement of the test tube and sample therein for producing a vortex in the test tube sample. The additional step of retaining the test tube by inflating a bladder within an open end of the test tube may also be included in the method. The additional step of sealing the open end of the test tube with the inflated bladder is part of the preferred method. The added step of holding the support on a three axis positioning means with one axis thereof parallel to the axis of the member may be another part of the method.

DETAILED DESCRIPTION OF THE DRAWINGS

Figure 1:
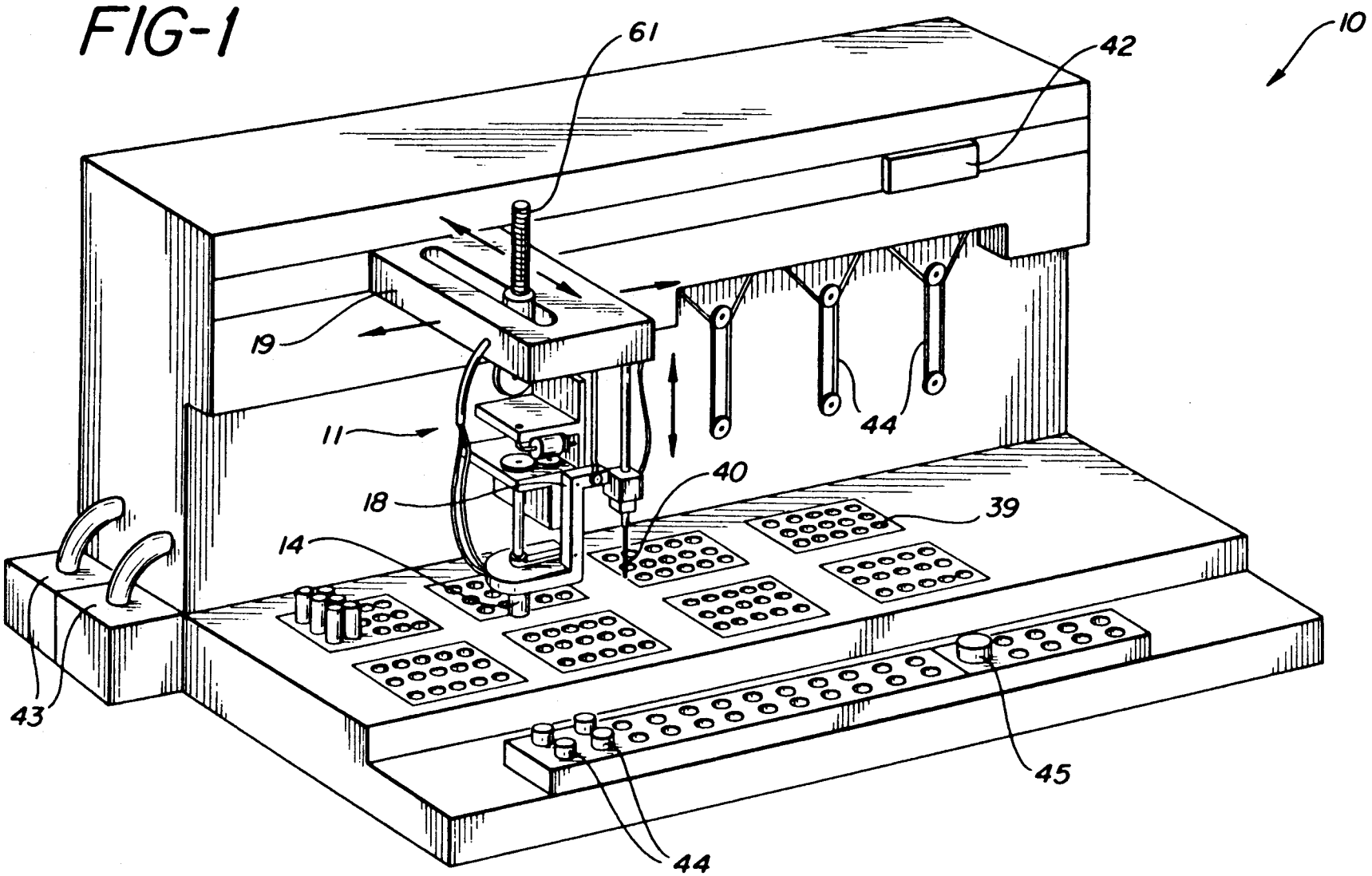
FIG. 1 is a perspective view of an apparatus having a preferred embodiment of a test tube handling assembly for causing a vortex in a test tube sample; a test tube is shown held in a gripper and a probe for adding and removing samples from the test tube and is carried on a three axis position means.

While this invention is satisfied by embodiments in many different forms, there is shown in the drawings and will herein be described in detail a preferred embodiment of the invention, with the understanding that the present disclosure is to be considered as exemplary of the principles of the invention and is not intended to limit the invention to the embodiments illustrated. The scope of the invention will be measured by the appended claims and their equivalents.

Figure 2:
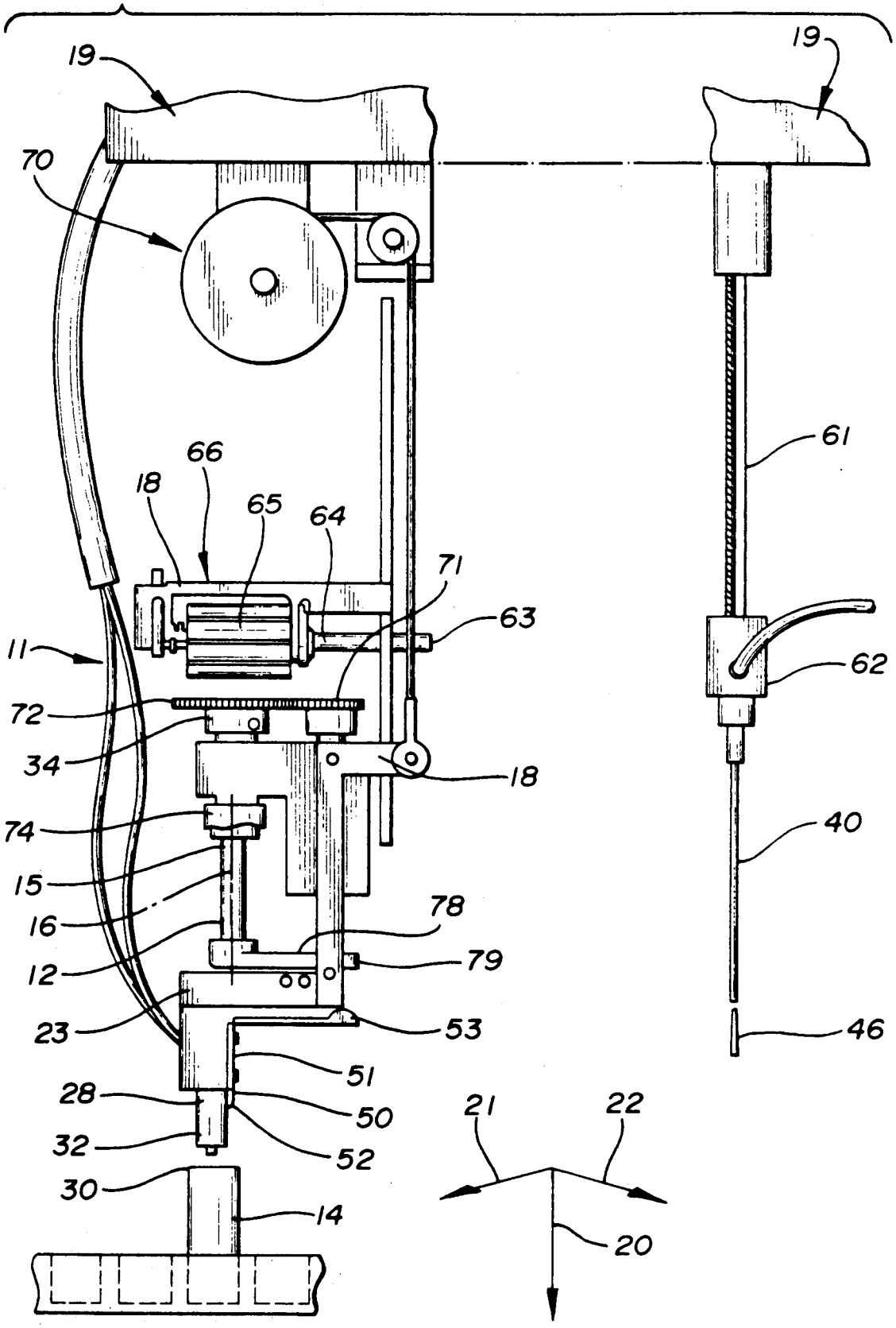
FIG. 2 is an enlarged front elevational view of the part of the test tube handling assembly for causing a vortex in a test tube sample of FIG. 1, showing the gripper lowered toward the test tube.
Figure 4:
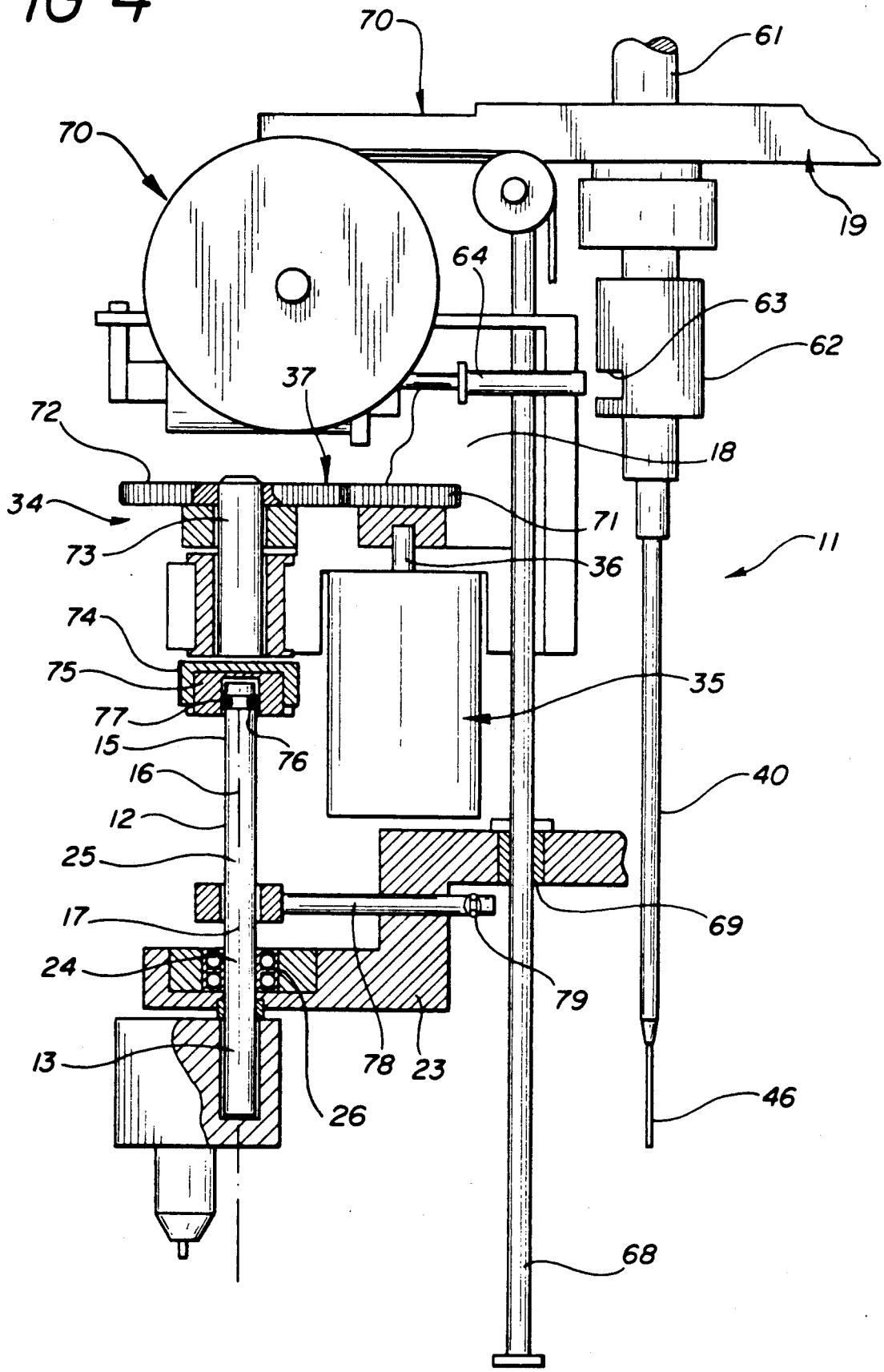
FIG. 4 is a view similar to that of FIG. 2 but enlarged and partially in cross section to show the solenoid engagement of the probe and the drive for the test tube gripper.

FIG. 1 illustrates an apparatus 10 containing the preferred embodiment of a test tube handling assembly 11 having a three axis positioning means for causing a vortex in a test tube sample comprising an elongated member 12 with an end for engaging 13 a test tube 14 and an end opposite 15 thereto driven with an axis 16 of the member 12 for orbital movement. As shown in FIGS. 2 and 4, member 12 has a center part 17 thereon between the ends 13 and 15 thereof and the center part 17 is located along the axis 16. A support 18 for the member 12 for carrying the center part 17 of the member 12 and permitting limited motion of the member 12 relative to the support 18. The support 18 is part of the three axis positioning means for the elongate member 12 wherein one of the axes 20 of movement of the three axis positioning means is substantially parallel with the axis 16 of the member 12 and member 19 is another part of the three axis positioning means wherein the other two axes 21 and 22 of movement are normal to the axis 16 of the member 12.

An arm 23 extends from the support to carry the member 12 center part 17 in spaced apart relation with respect to the support 18 so that orbital movement of the member 12 about the center part 17 is permitted without contact between the support 18 and the test tube 14 or the member 12. The center part 17 of the member 12 is supported on the arm 23 to carry the member so a point 24 on the axis 16 of the member 12 is free from movement as the member 12 and its axis 16 orbit and swing relative to the point 24 about the elongate length of the member 12. The member 12 is in the preferred embodiment a slender rod 25 and a spherical bearing 26 is carried in the arm 23 permitting orbital motion of the rod 25 and its axis 16 and swing movement about the point 24 in the center part 17. The end for engaging 13 carries passage 27 to permit material to be transported to and from the test tube 14 to be added or removed from the sample.

A test tube gripping means 28 on the end for engaging 13 the test tube 14 is able to hold the test tube 14 and the contents thereof during movement of the member 12 relative to the axis 16. The test tube gripping means 28 has test tube contacting means 29 in FIG. 3 for holding an open end 30 of the test tube 14 during movement of the member 12. The contacting means 29 includes a seal 31 for substantially closing the open end 30 of the test tube 14. The contacting means 29 is an inflatable bladder 32 which upon inflation expands and holds against the inside of the open end 30 of the test tube 14. The inflatable bladder 32 fits within the open end 30 of the test tube 14 when the bladder 32 is inflated. The open end 30 of the test tube 14 is substantially closed by the inflatable bladder 32. The bladder 32 having channels 33 thereabout permits air within the test tube 14 to escape when the bladder 32 is inflated and material is added to the test tube 14.

A drive 34 located on the support 18 near the end opposite 15 causes the test tube 14 to move relative to its axis 16 thereby swinging the test tube 14 about the center part 17 of the member 12. The drive 34 has a motor 35 for providing orbital motion. A motor axis 36 and the member axis 16 are in spaced parallel relation relative to each other with a linkage means 37 therebetween to cause the axis 16 and the member 12 to orbit imparting an orbital motion to the end opposite 15 of the member 12 thereby orbiting the end for engaging 13 the test tube 14.

A method for causing a vortex in a test tube sample with the test tube handling assembly 11 has the member 12 with the end for engaging 13 the test tube 14 and the end opposite 15 thereto driven about the axis 16 of the member 12 for movement relative to the axis 16. The member 12 has the center part 17 thereon between the ends 13 and 15 thereof and along the axis 16 and the support 18 for the member 12 carries the center part 17 of the member 12 and permits limited motion of the member 12 relative to the support 18. The test tube gripping means 28 is on the end for engaging 13 the test tube 14. The drive 34 is located on the support near the end opposite. The method includes the step of holding the test tube 14 by the gripping means 28 during orbital movement of the member 12 and its axis 16. The step of moving the test tube 14 repetitively with the drive 34 to cause the test tube 14 to orbit with the axis 16 and to swing about the center part 17 of the member 12 is also a part of the method. The method has the step of generating orbital movement of the test tube 14 and sample therein for producing a vortex in the test tube sample.

The method may also include the additional step of retaining the test tube 14 by inflating the bladder 32 within the open end 30 of the test tube 14. The method of retaining can further have the additional step of sealing the open end 30 of the test tube with the inflated bladder 32. The method of generating could be provided with the added step of holding the support 18 on member 12 wherein one axis 20 thereof is parallel to the axis 16 of the member 12. The method of generating may include the step of moving the test tube 14 with the drive 34 by driving the end opposite 15 with an eccentric 38 on the end opposite 15 of the member 12.

In use, the apparatus and method herein are part of a handling system for rack of twelve by seventy-five test tubes. That is to say that each test tube has a diameter of twelve millimeters and a length of seventy-five millimeters and there are twenty of these test tubes in a rack 39 as in FIG. 1. Eight racks 39 are placed in a test tube handling assembly means 11 having a three axis positioning means arranged such that a sample of, for example, human blood can be picked up by a probe 40 as shown in FIG. 2 and portions of that sample dispensed into each of the eight test tubes 14 held in each rack 39. The probe 40 also has access to as many as twelve containers 41 holding monoclonal antibodies which can be added to the test tubes 14 as required by the protocol and as controlled by the program in a microprocessor 42 which operates member 19. The probe 40 also is capable of accessing reagent bottles 43 by means of syringe pumps 44. The reagent bottles 43 have bulk quantities of reagent such that as required by the protocol the reagent may be added to the test tubes 14. Between each excursion of the probe into the test tubes and back to the supply, be it reagent, monoclonal or blood there is a washing operation which includes a well 45 into which the probe 40 is dipped and operated to clean the tip 46 of the probe 40 and the inside thereby removing any remaining material supplied during the previous operation. Once the particular test tube 14 has been filled with the appropriate supplies and samples the test tube handling assembly 11 can be used to grip and move the test tube in order to cause a vortex of the material in the test tube 14.

Figure 3:
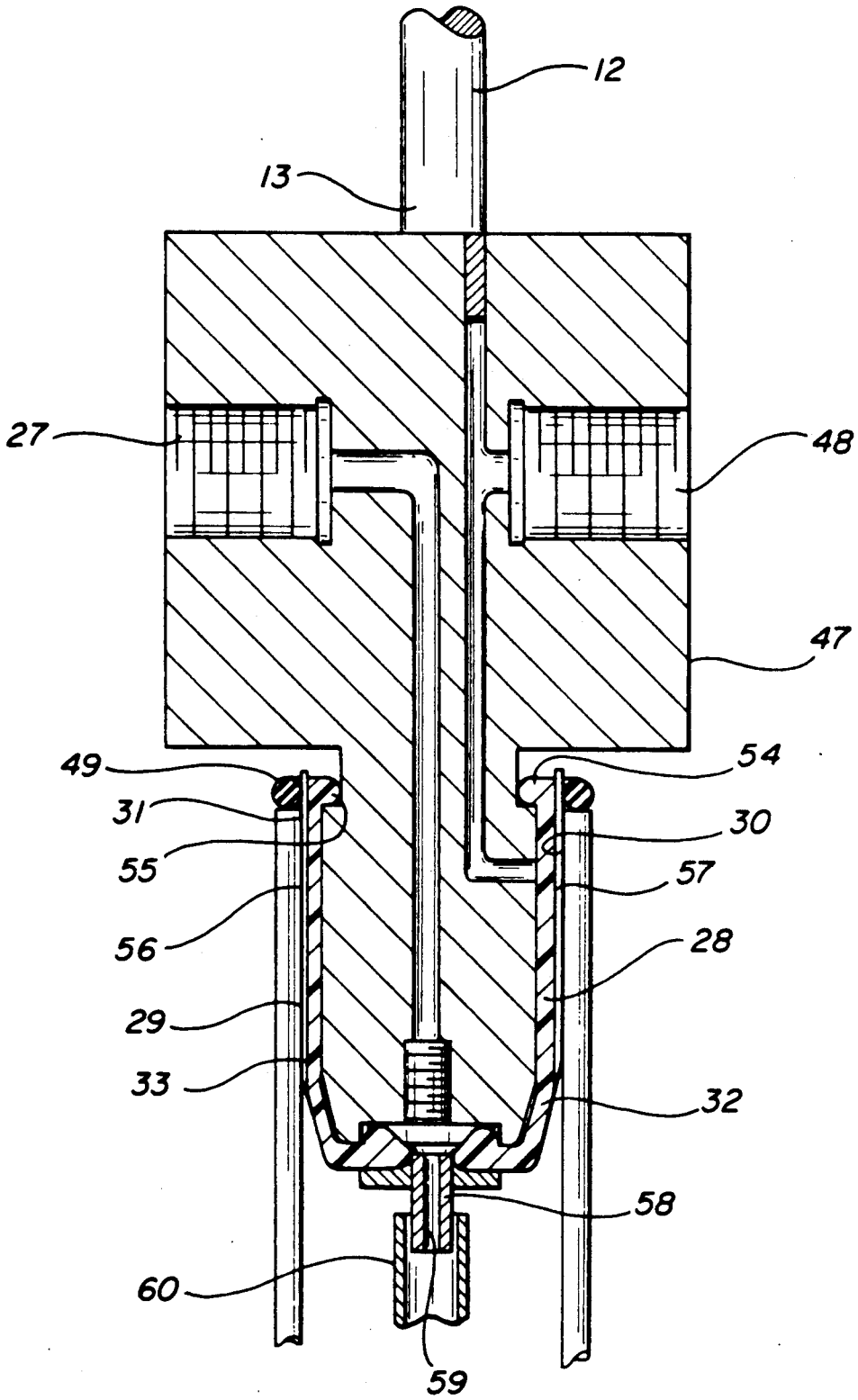
FIG. 3 is an enlarged cross sectional view of the preferred form of the inflatable bladder engaged with the open end of a test tube showing the channels which permit air to escape from the test tube when it is substantially closed by the inflated bladder and material is added; also shown is the passage for adding and removing samples.

There is also the passage 27 carried on the member 12 for permitting the addition of material or removal of material from the test tube 14 during the vortex generating movement. As shown in FIG. 3 passage 27 passes through a mandrel 47 carried on the end for engaging 13 of the member 12. The mandrel 47 also has a supply port 48 for providing air to inflate the bladder 32. An O-ring 49 is carried over the top of the bladder to hold the bladder on the mandrel 47. As shown in FIG. 2 the mandrel 47 has a detector 50 which includes a guide 51 for allowing a finger 52 to move when in contact with open end 30. A switch 53 is located on the support 18 such that movement of the finger 52 in the guide 51 due to contact with open end 30 causes the switch 53 to signal the micro processor 42 indicating that a test tube 14 in fully in place on the mandrel 47.

The relationship between the mandrel 47 and the bladder 32 is clear from the cross sectional view of FIG. 3 wherein the upper rim 54 of the bladder 32 seats in an annular recess 55 on the mandrel 47. Annular recess 55 is near where the O-ring 49 is carried. Ribs 56 longitudinally positioned on the side of the mandrel 47 which engages the inside open end 30 have channels 57 therebetween. The channels 57 permit air within the test tube 14 to escape when the bladder 32 is inflated and material is added to the test tube 14. A fitting 58 is used to sealing attach the mandrel 47 and the bladder 32 while providing an exit 59 for the passage 27 an extension tube 60 can be placed over fitting 58 to reach into the sample in the test tube 14.

In FIG. 2 the probe 40 is carried on a linear rack 61 which is a part of member 19. Movement of the linear rack 61 is controlled by the micro processor 42 and in the well known manner is also moved to and from and across the apparatus in the three directions of linear motion of axes 20, 21 and 22. A holder 62 for the probe 40 connects the linear rack 61 and the probe 40. Holder 62 has a drive notch 63 positioned to receive a plunger 64 from a solenoid 65 as part of a releasable latching means 66 between support 18 and the probe 40. In particular the elongated member 12 and associated parts are slidably carried on the support 18 by a guide shaft 68 as in FIG. 4 wherein a bushing 69 is between the support 18 and the shaft 68. A cord and spring loaded pulley arrangement 70 is used to support the weight of the elongated member 12 and associated parts such that when the solenoid plunger 64 is not engaged in the notch 63, the assembly 11 will not fall. When the plunger 64 is in the notch 63, the probe 40 and the elongated member 12 and associated parts move together in the direction of axis 20.

Motor 35 turns a pinion 71 to drive a gear 72 attached to drive shaft 73. The drive shaft 73 is drivingly connected to an inverted cup 74 which is eccentrically mounted on the drive shaft 73 in FIG. 4. The centers of the drive shaft 73 and the cup 74 are in the preferred embodiment 0.4 mm. apart and parallel to each other. In the cup 74 is a spacer 75 which engages the end opposite 15 of the member 12. An O-ring 76 is carried between the spacer 75 and the end opposite 15 in a groove 77 as a resilient coupling therebetween to permit wobble of the member 12 relative to the cup 74. A bracket 78 is connected to the arm 23 to surround the member 12 above the center part 17 and prevent rotation of the member 12. Springs 79 are used to attach the bracket 78 to the arm 23 and allow accommodation of the orbital motion.

Those skilled in the art understand that changes in materials, dimensions, physical relationships and the like may be made without departing from the scope of the invention covered by the claims which follow.

What is claimed is:

1. A test tube handling assembly for causing a vortex in a test tube sample comprising:

an elongated member with an end for engaging a test tube and an end opposite thereto driven about an axis of the member for orbital movement with the axis thereof, the member having a center part thereon between the ends thereof and along the axis;

a support for the member with an arm extending therefrom to carry the center part of the member and permit limited motion of the member relative to the support, the arm carries the center part in spaced apart relation with respect to the support so that movement of the member relative to the center part is permitted without contact between the support and the test tube or the member;

a test tube gripping means on the end for engaging the test tube, the gripping means having test tube contacting means able to hold the test tube and the contents thereof for engaging an open end of the test tube during movement of the member relative to the axis, the contacting means including an inflatable bladder which upon inflation holds the open end of the test tube with a seal for closing the open end of the test tube;

a drive located on the support near the end opposite and in contact with the gripping means, the drive having a motor carried on the support, the motor axis and the member axis are in spaced parallel relation relative to each other with a linkage means between the end opposite the motor axis to cause the axis of the member to orbit imparting an orbital motion to the end opposite of the member thereby orbiting the end for engaging the test tube to cause the test tube to move with the axis thereby swinging the test tube relative to the center part of the member.

2. The test tube handling assembly of claim 1 wherein the inflatable bladder fits within the open end of the test tube and when the bladder is inflated the open end of the test tube is substantially closed by the inflatable bladder.

3. The test tube handling assembly of claim 2 wherein the inflatable bladder comprises channels thereabout to permit air within the test tube to escape when the bladder is inflated and material is added to the test tube.

4. The test tube handling assembly of claim 2 wherein the arm extends from the support near the member center part in spaced apart relation with respect to the support so that orbital movement of the member about the center part and with the axis is permitted without rotary motion of the member relative to the axis of the member.

5. The test tube handling assembly of claim 2 wherein the center part of the member is carried on the support so a point on the axis of the member is free from orbital movement as the member swings relative to the point about the elongated length of the member.

6. The test tube handling assembly of claim 1 wherein the member is a slender rod with a spherical bearing and the support carries the spherical bearing permitting orbital motion of the rod with the axis and swing movement relative to the center part.

7. The test tube handling assembly of claim 6 wherein the center part of the member is supported on the arm to carry the member so a point on the axis of the member is free from movement as the member orbits about its axis and swings relative to the point about the elongate length of the member, the rod end for engaging is associated with a passage through which samples may be added or removed from the test tube.

8. The test tube handling assembly of claim 1 wherein the support for the elongate member is carried on a three axis positioning means and wherein one of the axes of movement of the three axis positioning means is substantially parallel with the axis of the member and the other two axes of movement of the three axis positioning means are normal to the axis of the member.

9. The test tube handling assembly of claim 1 wherein the support for the elongated member includes a releasable latching means for selective connection of the three axis positioning means and the support.

10. The test tube handling assembly of claim 9 wherein the gripping means includes a test tube detector to signal when the test tube is fully engaged therewith, the detector having a guide with a slidable finger responsive to the open end of the test tube with a three axis positioning means and wherein one of the axes of movement of the three axis positioning means is substantially parallel with the axis of the member and the other two axes of movement of the three axis positioning means are normal to the axis of the member.

* * * * *

UNITED STATES PATENT AND TRADEMARK OFFICE

CERTIFICATE OF CORRECTION

PATENT NO. : 5,005,981

DATED : April 9, 1991

INVENTOR(S) : Schulte et al

It is certified that error appears in the above-identified patent and that said Letters Patent is hereby corrected as shown below:

Title page should be deleted to appear as per attached title page.

The sheet of drawing consisting of Fig. 1, should be deleted and replaced with the attached sheet.

Signed and Sealed this

Third Day of November, 1992

*Attest:*

DOUGLAS B. COMER

*Attesting Officer*

*Acting Commissioner of Patents and Trademarks*

United States Patent [19]

Schulte et al.

[11] Patent Number: 5,005,981

[45] Date of Patent: Apr. 9, 1991

[54] APPARATUS FOR METHOD FOR CAUSING VORTICES IN A TEST TUBE

[75] Inventors: Harvey Schulte, Los Altos; Sal Noto, Sunnyvale, both of Calif.

[73] Assignee: Becton, Dickinson and Company, Franklin Lakes, N.J.

[21] Appl. No.: 405,803

[22] Filed: Sep. 8, 1989

[51] Int. Cl.[5] ..... B01F 13/08

[52] U.S. Cl. ..... 366/219; 494/16; 494/17; 494/18; 435/315; 435/313; 435/287; 435/2

[58] Field of Search ..... 366/219, 208, 209, 210, 366/211, 213, 214, 216, 217, 219, 232, 110, 111; 494/16, 17, 18, 19; 422/99, 100; 435/2, 206, 315, 316, 312, 287

[56] References Cited

U.S. PATENT DOCUMENTS

| | | | |
|---|---|---|---|
| 3,159,384 | 12/1964 | Davis | 366/110 |
| 4,555,183 | 11/1985 | Thomas | 366/208 |
| 4,845,025 | 7/1989 | Lary et al. . | |
| 4,848,917 | 7/1989 | Benin et al. | 366/110 |

*Primary Examiner*—Harvey C. Hornsby
*Assistant Examiner*—Gary K. Graham
*Attorney, Agent, or Firm*—Aaron Passman

[57] ABSTRACT

A test tube handling assembly has an elongate member with an end for engaging a test tube and an end opposite thereto driven about an axis of the member for orbital movement with its axis. The member is a slender rod with a spherical bearing about a center part thereon between the ends thereof and along its axis. An arm extends from a support to carry the spherical bearing and permit limited motion of the rod relative to the support. A gripping means on the end for engaging the test tube holds the test tube and its contents during movement of the rod relative to the axis. A drive located on the support near the end opposite causes the test tube to swing about the center part. Contacting means with a seal for closing the open end of the test tube is part of an inflatable bladder which holds the open end of the test tube by fitting in the open end of the test tube. The drive has a motor for providing orbital motion. The motor axis and the member axis are in spaced parallel relation relative to each other with a linkage means therebetween to cause the axis of the member to move about the axis of the motor imparting an orbital motion to the end opposite of the member thereby orbiting the end for engaging the test tube. A three axis positioning means carries the support by connection with a releasable latching means. A method has steps of holding a test tube by the gripping means, moving the test tube repetitively with the drive and generating orbital movement of the test tube and sample therein for producing a vortex in the test tube sample.

10 Claims, 4 Drawing Sheets

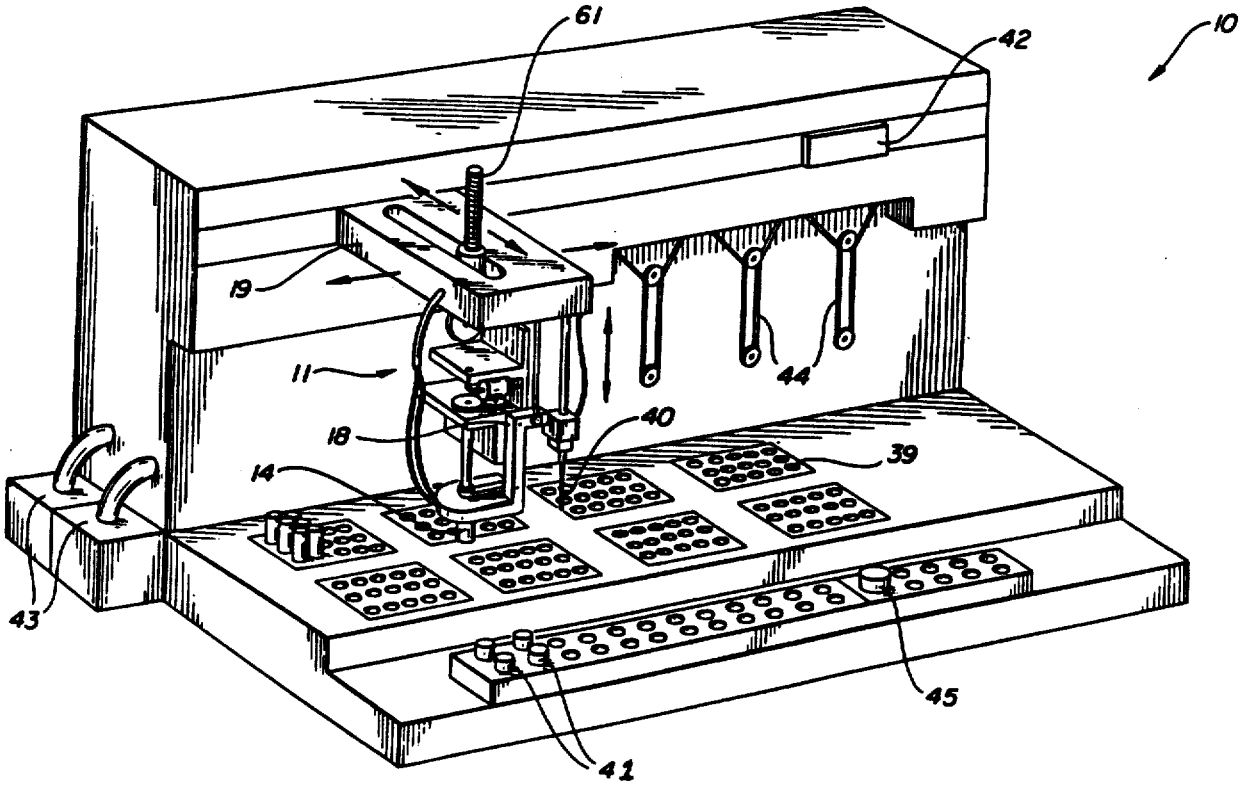

UNITED STATES PATENT AND TRADEMARK OFFICE

CERTIFICATE OF CORRECTION

PATENT NO. : 5,005,981

DATED : April 9, 1991

INVENTOR(S) : Schulte et al.

It is certified that error appears in the above-identified patent and that said Letters Patent is hereby corrected as shown below:

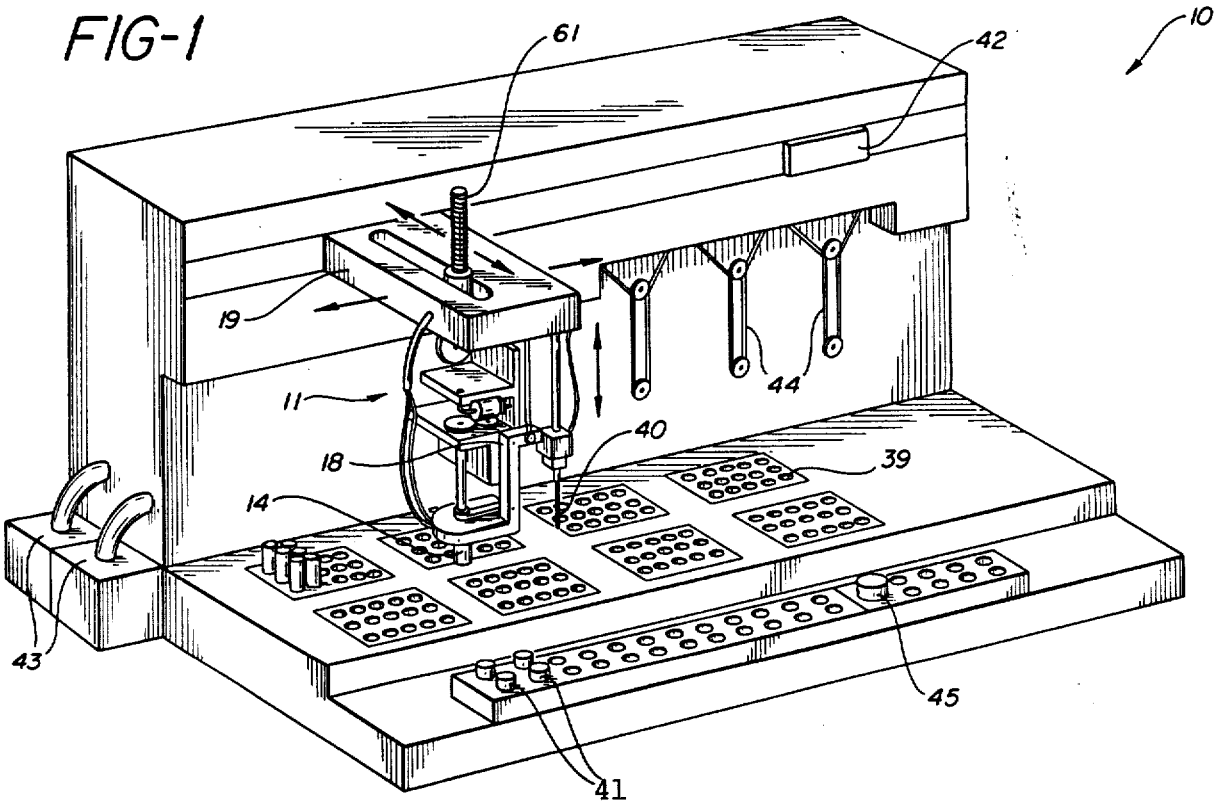

FIG-1